US009395135B2

(12) United States Patent
Randazzo et al.

(10) Patent No.: US 9,395,135 B2
(45) Date of Patent: Jul. 19, 2016

(54) FIREARM BARREL ASSEMBLY WITH PORTED CHAMBER

(71) Applicants: Robert S. Randazzo, Hayesville, NC (US); Joseph A. Worley, Hendersonville, NC (US); Michael H. Allen, Carthage, NC (US)

(72) Inventors: Robert S. Randazzo, Hayesville, NC (US); Joseph A. Worley, Hendersonville, NC (US); Michael H. Allen, Carthage, NC (US)

( * ) Notice: Subject to any disclaimer, the term of this patent is extended or adjusted under 35 U.S.C. 154(b) by 0 days.

(21) Appl. No.: 14/594,171

(22) Filed: Jan. 12, 2015

(65) Prior Publication Data

US 2015/0247694 A1 Sep. 3, 2015

Related U.S. Application Data

(60) Provisional application No. 61/946,045, filed on Feb. 28, 2014.

(51) Int. Cl.

| | |
|---|---|
| ***F41A 21/12*** | (2006.01) |
| ***F41A 5/24*** | (2006.01) |
| ***F41A 21/28*** | (2006.01) |

(52) U.S. Cl.

CPC . *F41A 21/12* (2013.01); *F41A 5/24* (2013.01); *F41A 21/28* (2013.01)

(58) Field of Classification Search

CPC ..... F41A 15/00; F41A 15/02; F41A 15/12; F41A 15/04; F41A 15/20; F41A 5/18; F41A 5/26; F41A 5/32; F41A 21/04; F41A 21/10; F41A 21/14; F41A 21/28

USPC ..... 42/25; 89/14.5, 14.7, 4.05

See application file for complete search history.

(56) References Cited

U.S. PATENT DOCUMENTS 490,614 A * 1/1893 Redwin ..... F41A 21/10 102/444

1,131,319 A 3/1915 Blish (Continued)

OTHER PUBLICATIONS

Randazzo; Robert S., AMT .22 Magnum Barrel Inspection Print, Date: Feb. 18, 2016.

*Primary Examiner* — Bret Hayes
*Assistant Examiner* — Derrick Morgan
(74) *Attorney, Agent, or Firm* — E J Asbury III, LLC

(57) ABSTRACT

A barrel assembly for use in a firearm that reduces the static bond due to propellant pressure between the cartridge case and the barrel chamber. The barrel assembly has a barrel with a rifled bore, and a chamber for receiving a cartridge therein. The barrel chamber having a throat portion adjacent the rifled bore, and the chamber also having a body portion for receiving the cartridge case therein. The cartridge comprising a cylindrical cartridge case, a bullet engaged within the cartridge case. The cartridge case contains a propellant producing a propellant pressure upon ignition of the propellant. A barrel sleeve configured to receive the barrel within and to positively engage the barrel. A recess is formed between the barrel and barrel sleeve, forming a propellant pressure interconnect passage. The barrel has supply ports passing from the chamber throat to the propellant pressure interconnect passage, and the release ports passing from the propellant pressure interconnect passage, and into the chamber body. Upon ignition of the propellant, the bullet is forced by propellant pressure out of the cartridge case and into the rifled bore of the barrel. The propellant pressure passes into the supply ports, into the propellant pressure interconnect passage, and into the release ports. The propellant pressure is then exerted upon the exterior of the cylindrical cartridge case. The static bond due to propellant pressure between the cartridge case and the barrel chamber is reduced and more energy is made available to cycle the firearm mechanism.

11 Claims, 5 Drawing Sheets

(56) References Cited

U.S. PATENT DOCUMENTS

| | | | | | |
|---|---|---|---|---|---|
| 1,864,374 | A * | 6/1932 | Schuler | F41A 1/06 | 188/204 R |
| 2,847,787 | A * | 8/1958 | Williams | F41A 3/32 | 42/17 |
| 3,057,100 | A * | 10/1962 | Dixon | F41A 3/26 | 42/25 |
| 3,611,867 | A * | 10/1971 | Silsby | F41A 21/28 | 42/105 |
| 3,943,821 | A * | 3/1976 | Seifried | F41A 21/12 | 89/16 |
| 5,475,940 | A * | 12/1995 | Mauch | F41A 13/12 | 42/75.02 |
| 5,479,737 | A * | 1/1996 | Osborne | F41A 21/12 | 42/76.01 |
| 5,734,120 | A | 3/1998 | Besselink | | |
| 5,937,563 | A * | 8/1999 | Schuetz | F41A 21/10 | 42/106 |
| 6,622,610 | B2 | 9/2003 | Adkins | | |
| 6,868,770 | B2 | 3/2005 | Cornils | | |
| 7,228,778 | B2 * | 6/2007 | Edwards | F41A 25/02 | 42/1.06 |
| 7,311,032 | B2 * | 12/2007 | Murello | F41A 5/18 | 89/191.01 |
| 8,065,949 | B1 | 11/2011 | Molinari | | |
| 8,307,751 | B2 | 11/2012 | Adolphsen | | |
| 8,443,712 | B2 | 5/2013 | Molinari | | |
| 8,640,598 | B1 | 2/2014 | Jackson | | |
| 8,701,543 | B2 | 4/2014 | Brinkmeyer et al. | | |
| 8,746,126 | B2 | 6/2014 | Zheng | | |
| 2003/0056639 | A1 * | 3/2003 | Giza | F41A 3/54 | 89/1.701 |
| 2014/0075805 | A1 * | 3/2014 | Larue | F41A 21/12 | 42/25 |
| 2014/0150638 | A1 | 6/2014 | Ricks | | |
| 2014/0260945 | A1 * | 9/2014 | Desomma | F41A 21/12 | 89/191.01 |
| 2014/0352188 | A1 * | 12/2014 | Widder | F42B 5/184 | 42/14 |
| 2015/0168092 | A1 * | 6/2015 | Stone | F41A 21/28 | 42/76.01 |
| 2015/0247694 | A1 * | 9/2015 | Randazzo | F41A 21/12 | 89/14.7 |

* cited by examiner

FIREARM BARREL ASSEMBLY WITH PORTED CHAMBER

CROSS-REFERENCE TO RELATED APPLICATION

This application claims the benefit of U.S. Provisional Application Ser. No. 61/946,045, filed on Feb. 28, 2014, the entirety of which is hereby incorporated herein by reference.

BACKGROUND OF THE INVENTION

1. Field of the Invention

The present invention relates generally to firearms having reciprocating cartridge handling elements such as slides or bolts and which are automatically operated by recoil force, or gas pressure, or a combination thereof, upon firing, for feeding cartridges from a magazine to the cartridge chamber of a firearm barrel and for extracting and ejecting the cases of spent cartridges. More specifically, the present invention has effective application in semi-automatic or fully automatic firearms of the type having a recoil force operated, or gas pressure operated, or a combination thereof, spring returned reciprocating bolt, or a slide with integral bolt, which extracts and ejects the cartridge cases of spent cartridges from the cartridge chamber of the gun barrel during its rearward or recoil movement of the bolt or slide, and which feeds cartridges from a cartridge magazine into the cartridge chamber of the gun barrel during the bolt or slide forward or returned movement.

2. Description of the Related Art

The firearms industry offers many caliber and cartridge configurations for use. Of particular popularity with recreational, sport, and match shooters are the small caliber, high velocity rounds currently available. One example is the .22 Magnum cartridge. The terms .22 Magnum, .22 WMR and .22 Winchester® Magnum Rimfire are used interchangeably herein to refer to a widely known ammunition which is commercially available from many sources. Another example of a small caliber, high velocity round is the .17 HMR.

The firearms industry has been trying to produce a semi-automatic .22 Magnum for many years with very little success. In spite of the poor performance by many of the .22 magnum semi-automatics available, the firearm is still highly sought after because of the spectacular performance of the round itself. The high velocity round has a flat trajectory with little recoil. Many firearms manufacturers would like to produce a .22 Magnum weapon but, simply do not pursue one due to some inherit problems associated with cartridges of this type. A common problem associated with the .22 Magnum semi-automatics available is a failure to cycle the firearm mechanism upon firing, and to extract the spent cartridge reliably.

In a typical center-fire cartridge as used in a firearm. The cartridge has a cylindrical case body, with one end closed, and is typically made of a brass alloy. The closed end of the cartridge case has a primer cap inserted within and opening in the center of the closed end. A bullet is inserted into the opposing end of the brass case. The body of the cartridge case is filled with gunpowder, or as referred to herein "propellant." Upon the firing pin of the firearm striking the primer cap, the primer cap, ignites, or burns. The ignited primer cap then ignites the propellant within the cartridge case. The pressure created by the ignited propellant then drives the bullet out of the cartridge case and down the rifled barrel of the firearm. As will be appreciated by those skilled in the art, rim-fire cartridge designs are also used in many firearms. The propellant in a rim-fire cartridge is ignited by striking the rim of the cartridge case by the firing pin of the firearm.

In a firearm mechanism, the brass cartridge is driven back into the bolt face due to the propellant pressure. In blowback enabled firearm mechanism, as are known in the art, the force of the cartridge case upon the bolt face is utilized to cycle the mechanism. Other types of firearm mechanism, such as recoil, gas operated, blow-forward, and assisted blowback, all fully, or partially, utilize the force of the brass cartridge upon the bolt face to cycle the firearm mechanism.

It is known in the art that certain dissimilar metals tend to stick to each other if very high pressure is applied. The temporary mechanical bond of dissimilar metals under high pressure was discovered by a naval armament engineer named John Blish. This principle of metal-to-metal adhesion in firearms is known as the "Blish principle" or "Blish effect." This adhesive force is due to static friction between the two dissimilar metallic surfaces of the cartridge case and barrel chamber being driven together at high pressures. The Blish effect is used to advantage in the firing chambers of most cartridge firearms. When a cartridge ignites within a firearm chamber, the brass cartridge case expands against the steel chamber of the barrel causing a temporary static bond, and high friction, between the walls of the barrel chamber and the cartridge case. This bond is desirable when it comes to firearms because it allows the cartridge case to swell, or obturate, thus sealing the chamber preventing gases from escaping. A secondary effect reduces the foot pounds of thrust on the breech face exerted by the cartridge case due to the exploding gun powder, or propellant, within.

In the case of the .22 Magnum, and other cartridge rounds known in the art, the Blish effect may preclude proper cycling of the firearm mechanism. The brass of the cartridge, is driven into contact with the steel of the barrel chamber by the pressure of the exploding powder. The brass cartridge expands within the chamber due to the propellant pressure, and the static bond of the Blish effect locks the cartridge within the chamber. The static bond remains until the propellant pressure has reduced, and the cartridge is then forced back against the bolt. The Blish effect thereby reduces the force applied to the bolt face of the firearm mechanism. As the cartridge case begins to withdraw from the chamber, the dynamic friction between the expanded cartridge case and chamber, further reduce the force applied to the bolt face of the firearm mechanism. The firearm mechanism may fail to cycle properly because of the diminished force applied to the bolt face by the cartridge. Specifically, the .22 Magnum cartridge will often fail to cycle the firearm mechanism, and fail to eject, because it is temporarily adhered to the chamber walls within firearm barrel even as the bullet exits the barrel. In order for any .22 Magnum semi-automatic to function properly and reliably cycle, this problem must be remedied.

In the case of the 22 Magnum in a semi-automatic pistol this static bond lasts longer than it takes for the high velocity bullet to exit the barrel leaving little energy remaining to cycle the firearm mechanism. The shorter the barrel, as in the case of pistols, the less energy there is available to operate the firearm mechanism. After the bullet exits the barrel, the pressure within the firearm chamber and bore quickly dissipates. Compounding the problem, the .22 Magnum contains a relatively light powder charge, supplying little energy to cycle the firearm mechanism.

A discussion of propellant pressures generated in the chamber and barrel of a firearm is disclosed in U.S. Pat. No. 1,131,319, issued to Blish. Within the Blish patent, the principal of dissimilar metal adhesion under pressure is used to advantage. The Blish patent discloses essentially a breech locking mechanism that could be used on a blowback operated firearm. The breech locking mechanism delays the blowback of the bolt until the chamber pressure has diminished to an acceptable level.

With the popularity of the new small caliber, high velocity, flat trajectory rounds in the shooting community, a demand to use the rounds in existing firearms has been created. Many recreation and sport shooters own multiple handguns or rifles chambered in more traditional calibers such as .45 ACP and 9 mm Parabellum. It would be desirable to provide a means of replacing the barrels and bolts of existing firearms with components configured to fire the new small caliber, high velocity cartridges. The re-use of the frame, receiver, trigger group, safety group, and other stock components of existing firearms with new components configured for use with the new cartridges would represent a significant cost savings to the shooting enthusiast. Moreover, the firearm may be readily converted back to the prior, more traditional, caliber when desired by reinstallation of the old stock components.

According, it would be advantageous to provide a barrel assembly to allow the use of the new small caliber, high velocity rounds reliably in an automatic or semi-automatic firearm. Such a barrel assembly would provide an accurate platform for use of the cartridge, while aiding the reliable and consistent cycling of the firearm mechanism. The barrel assembly would also be configured for ease of manufacture in high volumes, and be of a robust construction to ensure the safety and integrity of the barrel assembly over the life of the firearm. It would also be advantageous to provide a firearm conversion kit to enable the conversion of the barrel and bolt assembly of existing firearms to fire the new small caliber, high velocity rounds. It is thus to such a firearm barrel assembly that the present invention is primarily directed.

SUMMARY OF THE INVENTION

The disadvantages of the prior art are overcome by the present invention which, in one aspect, is a barrel assembly for use in a firearm that reduces the static bond due to propellant pressure between the cartridge case and the barrel chamber. The barrel assembly has a barrel with a rifled bore, and a chamber for receiving a cartridge therein. The barrel chamber having a throat portion adjacent the rifled bore, and the chamber also having a body portion for receiving the cartridge case therein. The cartridge comprising a cylindrical cartridge case, a bullet engaged within the cartridge case. The cartridge case contains a propellant producing a propellant pressure upon ignition of the propellant.

In another aspect, the barrel assembly has a barrel sleeve configured to receive the barrel within and to positively engage the barrel. A recess is formed between the barrel and barrel sleeve, forming a propellant pressure interconnect passage. The barrel has supply ports passing from the chamber throat to the propellant pressure interconnect passage, and the release ports passing from the propellant pressure interconnect passage, and into the chamber body.

Upon ignition of the propellant, the bullet is forced by propellant pressure out of the cartridge case and into the rifled bore of the barrel. The propellant pressure passes into the supply ports, into the propellant pressure interconnect passage, and into the release ports. The propellant pressure is then exerted upon the exterior of the cylindrical cartridge case. The static bond due to propellant pressure between the cartridge case and the barrel chamber is reduced. In an alternative aspect of the present invention, the supply ports may be located in the rifled barrel, or a combination of ports within the chamber throat and the rifled barrel.

In another aspect, the propellant pressure passes into the release ports, and the cartridge case is released from the barrel chamber. The cartridge case is then driven back against a bolt of the firearm mechanism by the propellant pressure. The firearm mechanism then cycles, and a new cartridge is forced into the barrel chamber.

In another aspect, a recess in the outer circumference of the barrel at the portion of the barrel engaged by the barrel sleeve, forms the propellant pressure interconnect passage. Alternatively, a recess in the inner bore of the barrel sleeve, at the portion of the barrel sleeve engaged by the barrel, forms the propellant pressure interconnect passage, or any combination thereof.

In other aspects of the present invention, the diameter of the release ports is less than 0.052 inch. Preferably, the diameter of the release ports is between 0.039 inch to 0.043 inch, and the diameter of the at least one supply port is between 0.056 inch to 0.060 inch. In another aspect, the total cross-sectional area of the supply ports is within +/−25% of the total cross sectional area of the release ports. More preferably, a total of 6 supply ports pass through the barrel and into the chamber throat. The supply ports are equally spaced around the circumference of the barrel, and at two distinct cross sections within the chamber body of the barrel, 6 release ports pass through the barrel and into the chamber body. The release ports are equally spaced around the circumference of the barrel, for a total of 12 release ports passing through the barrel and into the chamber body. And the cartridge of the firearm is a .22 caliber Magnum, or a .17 HMR.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

The present invention provides a barrel assembly for use in a firearm that reduces the static bond due to propellant pressure between the cartridge case and the barrel chamber. The barrel assembly aids the use of the new small caliber, high velocity rounds reliably in an automatic or semi-automatic firearm. The barrel assembly aids in the reliable cycling of the firearm. The barrel assembly may be used within many existing firearm designs and is configured for ease of manufacture in high volumes. The present invention also provides a firearm conversion kit to enable the conversion of the barrel and bolt assembly of existing firearms to fire the new small caliber, high velocity rounds.

Though the present invention is discussed herein particularly as it relates to handguns utilizing a slide with integral bolt face, it is to be understood such discussion is intended solely to promote an understanding of the invention. As will be appreciated by those skilled in the art, the spirit and scope of the present invention has applications in many other types of firearms, to include handguns, shoulder fired firearms, fully automatic and semi-automatic firearms, and firearms with bolts, or slides with integral bolt faces, that are automatically operated, or cycled, upon firing to extract and eject the cartridge case of an expended cartridge and for forcing a new cartridge from a magazine or clip into the firearm. The term "bolt" as used herein is intended to mean any device that is forced back from the firearm barrel by a fired or ignited cartridge case, and includes the slides of handguns, and the bolts of rifles, whether of semi-automatic or fully automatic operation. The term "firearm mechanism" as used herein is intended to mean that assembly of components within the firearm which is operated by blowback, recoil, gas operated, blow-forward, and assisted blowback, or any combination thereof by a fired or ignited cartridge. The term "cycle" as used herein is intended to mean the movement of the firearm mechanism upon firing, in which the bolt or slide moves rearward to extract and eject a fired cartridge case from the cartridge chamber of the barrel, and the bolt or slide then urged forward by a return spring to force a new cartridge from a cartridge magazine or clip into the cartridge chamber of the barrel.

Figure 1:
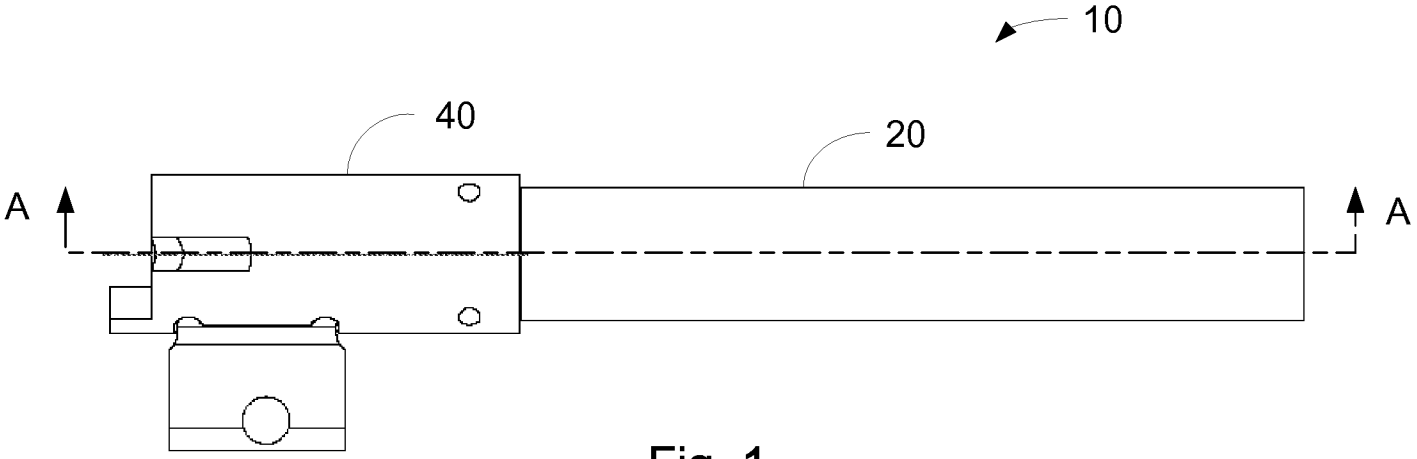
FIG. 1 is a side-perspective view of the barrel assembly of the present invention.

A first embodiment of the present invention is depicted in FIG. 1. The barrel assembly 10 of the present invention includes a barrel 20 and a barrel sleeve 40. As depicted in the cross-sectional view of FIG. 2, taken at cross-section "A-A" of FIG. 1, the barrel 20 is a cylindrical turning of varying external diameters. The barrel 20 also has a chamber opening 22 for receiving a cartridge therein, and a rifled bore 24. The barrel sleeve 40 has a through bore to engage and surround the chamber end of the barrel 20. At each end of the barrel sleeve 40, the exterior diameter of the barrel and the internal diameter of the bore within the barrel sleeve are closely matched to preclude the escape of propellant gases. In the prior provisional application noted above, the barrel sleeve was referenced as a barrel extension, the terms "barrel sleeve" and "barrel extension" have equivalent meanings herein.

Figure 2:
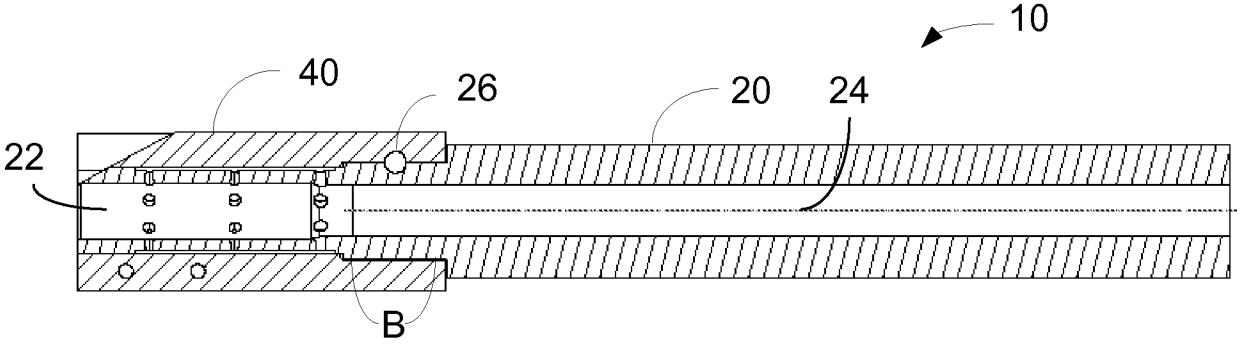
FIG. 2 is a cross-sectional view of the barrel assembly of FIG. 1.

As further depicted in FIG. 2 a pin 26 permanently secures the barrel within the barrel sleeve. In an alternative embodiment of the present invention, the barrel exterior diameter at "B" may be externally threaded, and a complimentary internal thread may be cut within the barrel sleeve at "B". The threaded engagement of the barrel and barrel sleeve allows ready disassembly for cleaning of propellant deposits from the components.

Figure 3A:
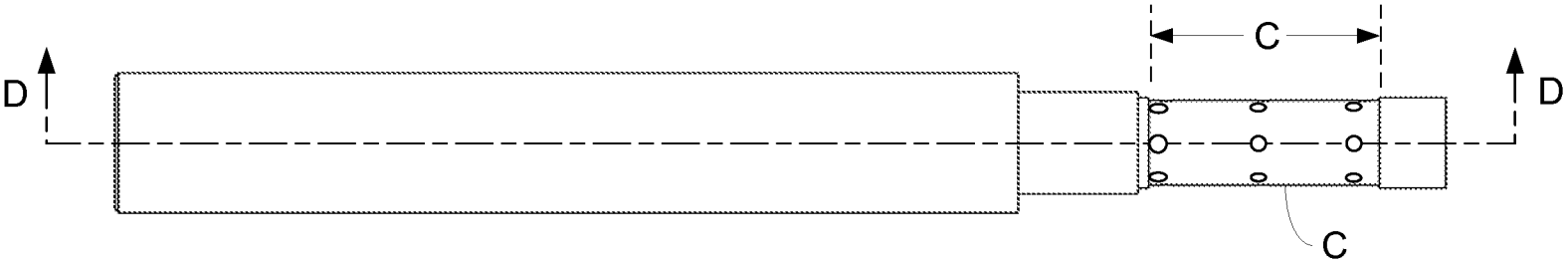
FIG. 3A is a side-perspective view of the barrel of the present invention.
Figure 3B:
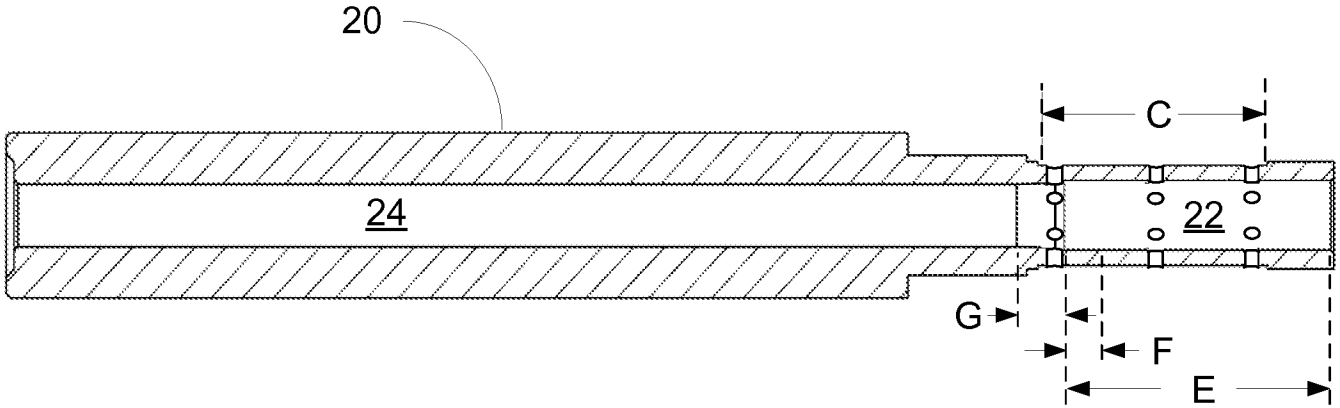
FIG. 3B is a cross-sectional view of the barrel of FIG. 3A.
Figure 3C:
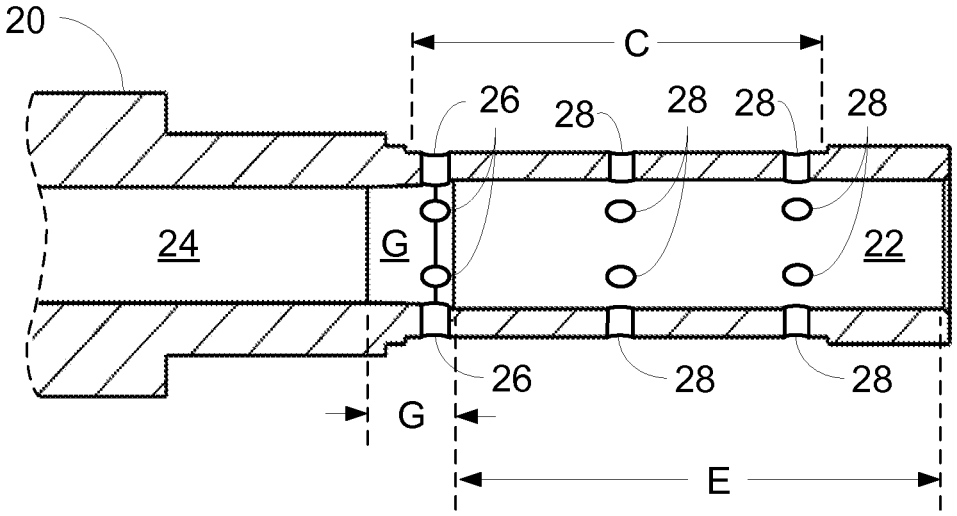
FIG. 3C is an enlarged cross-sectional view of the chamber end of the barrel of FIG. 3A.

As depicted in FIG. 3A, the barrel 20 has a reduced diameter portion "C" on the exterior of the barrel surrounding the chamber 22. FIG. 3B is a cross-sectional view of the barrel 20 of FIG. 3A, taken at cross-section "D-D", showing the chamber 22 and reduced diameter portion "C". FIG. 3C is an enlarged view of the chamber end of the barrel of FIG. 3B. As depicted in FIG. 3B, the chamber 22 within the barrel 20 is configured to engage and positively surround a cartridge inserted within the barrel. As described from the opening of the chamber 22 in the barrel end, and moving forward toward the front of the chamber 22 adjacent to the rifled bore 24 of the barrel 20, the portion of the chamber 22 which is configured to receive and make contact with the case of an inserted cartridge 50 is commonly referred to in the art as the chamber body, shown pictorially as "E". The forward portion of the chamber body "E" is commonly referred to as the chamber neck, shown pictorially as "F". At the front of the chamber 22, between the chamber neck "F" and the start of the rifled bore 24 is, and what is commonly referred to in the art as, the throat portion of the chamber, shown pictorially as "G". The chamber throat "G" provides a volume for the bullet of an inserted cartridge to project out into between the chamber neck "F", and the rifled bore 24 of the barrel 20.

As will be appreciated by those skilled in the art, many configurations of cartridges and complimentary chamber shapes are used in modern firearms. In some chamber configurations, the chamber neck is a reduced diameter from the chamber body, and the transitional conical surface between is referred to as the chamber shoulder. As defined herein, the "chamber neck" is that portion of the chamber which is adjacent and surrounding the bullet end of a cartridge case inserted in the chamber. As further defined herein, the "chamber throat" is that portion of the chamber between the chamber neck and the rifled bore of the barrel.

Figure 3D:
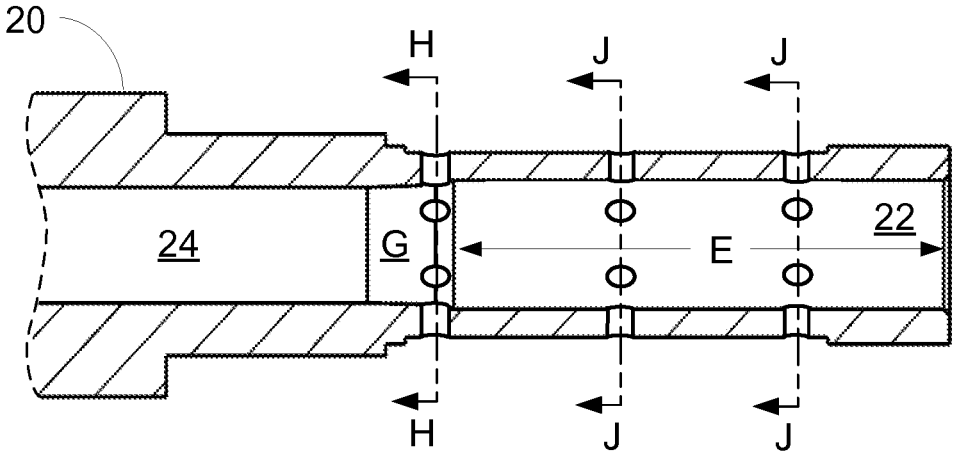
FIG. 3D is second enlarged cross-sectional view of the chamber end of the barrel of FIG. 3A.
Figure 3E:
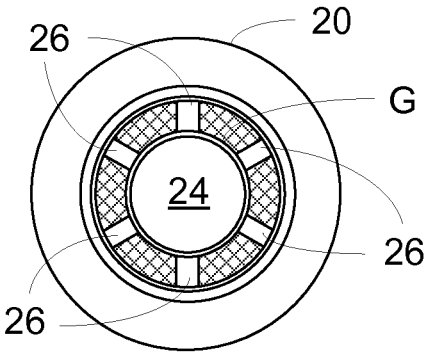
FIG. 3E is cross-sectional view taken thru the supply ports of the barrel of FIG. 3A.
Figure 3F:
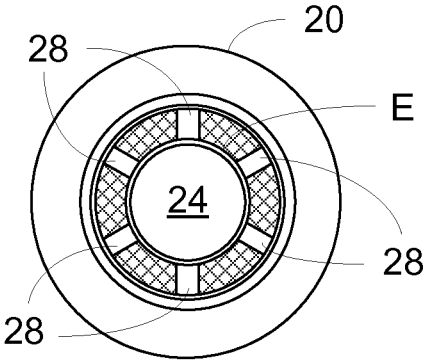
FIG. 3F is cross-sectional view taken thru the release ports of the barrel of FIG. 3A.

As further depicted in FIG. 3C, a plurality of passages, referred to herein as supply ports 26, are formed from the reduced diameter exterior of the barrel "C", through the barrel body, and terminating within the chamber throat portion "G". A second plurality of passages, referred to herein as release ports 28, are formed from the reduced diameter exterior of the barrel "C", through the barrel body, and terminating within the chamber body portion "E". As depicted in FIG. 3C, a total of 6 (six) supply ports 26 are equally spaced around the circumference of the barrel 20 at the chamber throat "G". At 2 (two) distinct cross sections within the chamber body of the barrel, 6 (six) release ports 28 are equally spaced around the circumference of the barrel, for a total of 12 (twelve) release ports piercing the chamber body. FIG. 3D defines cross-section "H-H" through the supply port 26 locations, and defines two cross-sections "J-J" through the release port 28 locations. For clarity, the full cross-sections of the barrel are depicted in "H-H" and "J-J". FIG. 3E depicts cross-section "H-H", and FIG. 3F depicts cross-section "J-J". In each cross-section "H-H" and "J-J", the supply ports 26 and release ports 28 respectively are equally spaced at 60 degree intervals around the circumference of the barrel 20. As will be appreciated by those skilled in the art, other configurations of supply and release port quantity and spacing may be employed within the present invention. Other alternative embodiments of release port spacing include, but is not limited to, single or multiple lines of release ports, either in straight lines, or spiraling about the barrel axis, along the body of the chamber.

Figure 4A:
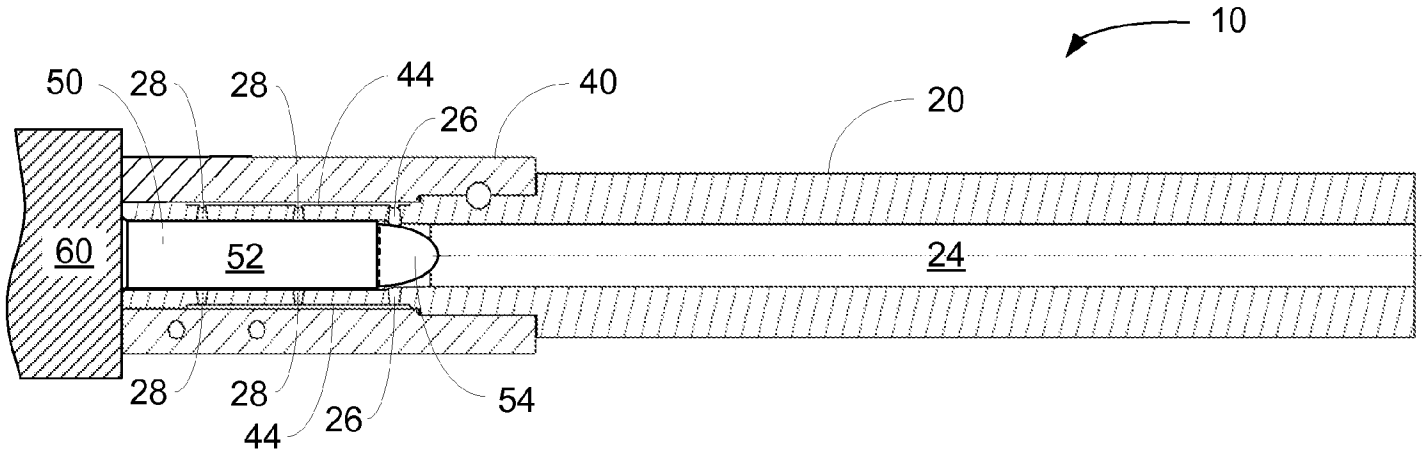
FIG. 4A is a cross-sectional view of the barrel assembly of the present invention, depicting a cartridge within the chamber, and bolt adjacent the barrel end.

FIG. 4A is a cross-sectional view depicting a cartridge 50 inserted within the barrel assembly 10 of the present invention. The cartridge case 52 and bullet 54 are received within the barrel chamber 22. The bullet 54 projects forward out of the cartridge case 52, into the chamber throat portion "G" and into the rifled bore 24. As further depicted in FIG. 4A, the reduced diameter portion of the barrel 20, in engagement with the barrel sleeve 40, forms a hollow cylindrical, or tube shaped, void space between the barrel and the barrel sleeve.

The supply ports 26 and release ports 28 of the barrel terminate in the void space. The void space is referred to herein as interconnect passage 44.

Figure 4B:
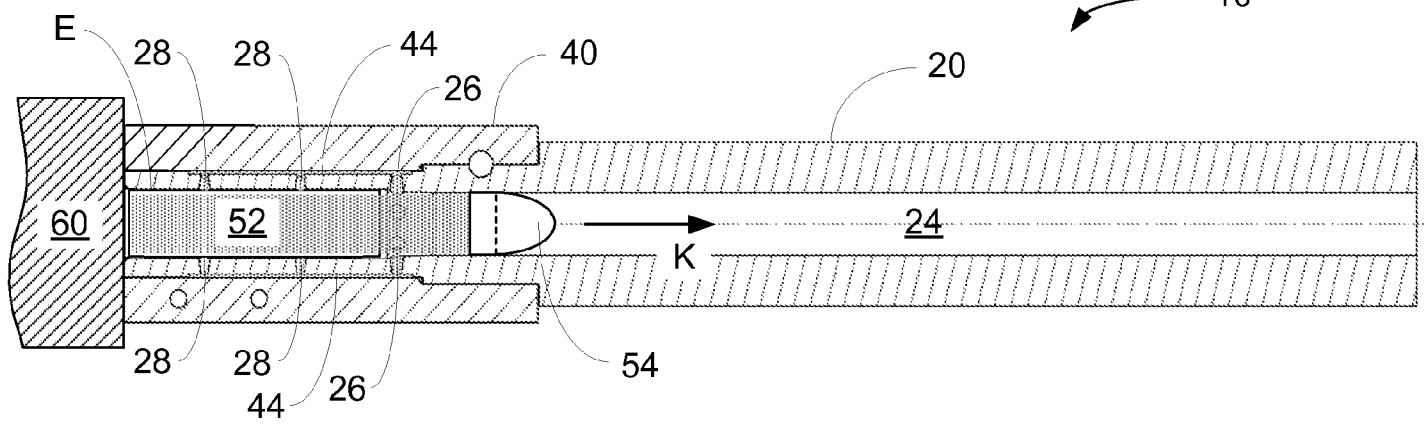
FIG. 4B is the cross-sectional view of the barrel assembly of FIG. 4A, depicting the cartridge igniting within the chamber.
Figure 4C:
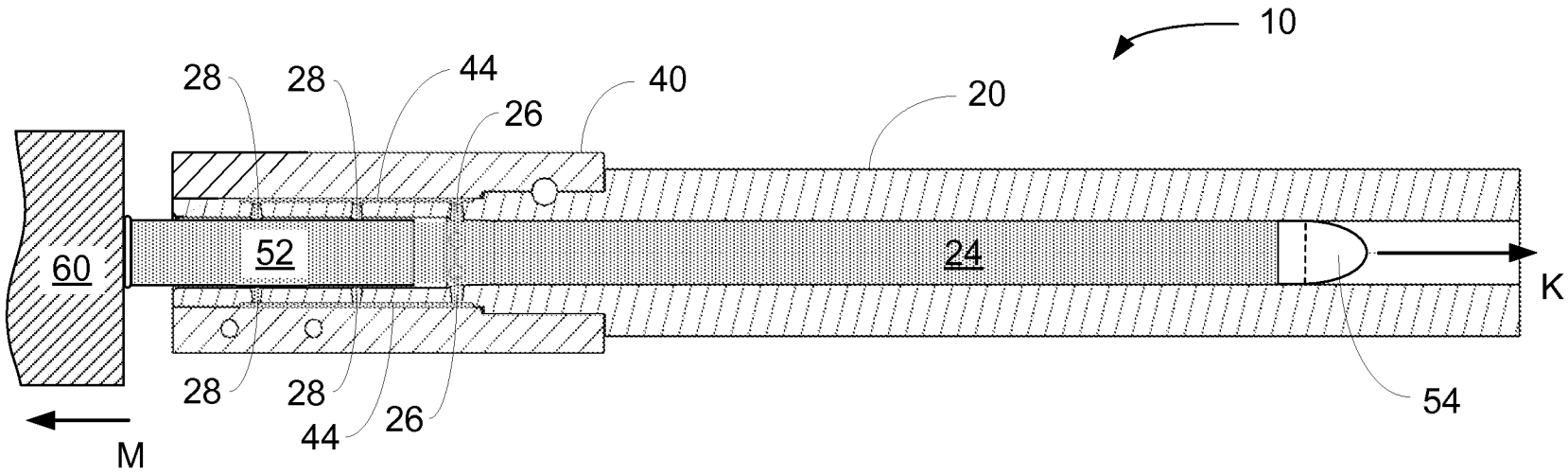
FIG. 4C is the cross-sectional view of the barrel assembly of FIG. 4A, depicting the cartridge case driven from the chamber by propellant pressure and forcing the bolt back.

FIG. 4B is a cross-sectional view depicting firing, or igniting, a cartridge 50 inserted within the barrel assembly 10 of the present invention. The pressure of the ignited propellant is depicted in FIGS. 4B-4C by stippling. The bullet 54 is forced forward and down the barrel by the pressure generated by the ignited propellant, in the direction of arrow "K". Upon the bullet moving only a short distance forward, 0.200 inch in a first exemplary embodiment, the propellant pressure enters the supply ports 26. The propellant pressure then pressurizes the interconnect passage 44, and release ports 28. The propellant pressure entering the release ports 28 acts on the exterior of the cartridge case 52. The swelling or expansion of the cartridge case 52 due to the internal propellant pressure is reduced, with a subsequent reduction in the pressure between the cartridge case 52 and the surface of the chamber body "E". The spent or fired cartridge 52 case more easily releases from the chamber walls to be forced back into the bolt 60, or slide, of the firearm by the propellant pressure. Stated another way, the static bond between the cartridge case 52 and the barrel chamber 22 is reduced, and the propellant pressure is able to drive the spent cartridge case 52 out of the chamber 22 and back into the bolt 60 with sufficient force to actuate, or cycle, the firearm mechanism. FIG. 4C is a cross-sectional view depicting the fired cartridge case 52 being driven out of the chamber 22 by the propellant pressure and forcing the bolt 60 back, in the direction of arrow "M".

The barrel assembly of the present invention may be readily applied to a semi-automatic handgun utilizing a blowback style firearm mechanism as is known in the art. The present invention may be applied to many other types of firearm mechanisms. In another exemplary embodiment, the Government Model 1911A1 is a popular semi-automatic handgun, using a combination of recoil and blowback to operate the firearm mechanism. In the 1911A1 design, both the barrel and slide move rearward in recoil from a fired cartridge. The rearward movement of the barrel is in the range of 0.100 to the 0.200 inch. As the slide moves rearward, the integral bolt face of the slide separates from the rear of the barrel. As the rearward movement of the barrel slows, and the slide continues to move back, an extractor mounted to the slide operates on the lip of the spent cartridge, and attempts to pull the cartridge from the barrel chamber. By application of the ported chamber barrel assembly of the present invention, the spent or fired cartridge case more easily releases from the chamber walls, and is driven back into the bolt face of the slide by the propellant pressure with sufficient force to drive the slide fully rearward and operate, or cycle, the firearm mechanism. As the slide travels rearward, the released cartridge is then readily pulled from the barrel chamber by the extractor. In the case of a semi-automatic handgun firing a small caliber, high velocity cartridge, absent the ported chamber of the present invention, the Blish Effect may preclude the cartridge case from being driven back into the bolt face with sufficient force to operate the handgun slide, and may preclude the proper extraction of the spent cartridge from the barrel chamber.

In an alternative embodiment of the present invention, the pressure supply port 26 is located within the rifled bore 24 of the barrel. The interconnect passage 44 meets the supply ports 26 and the release ports 28. When a bullet is fired within the chamber 22, propellant pressure is supplied to the release ports 28 after the bullet passes the supply port location within the rifled bore 24. As will be appreciated by those skilled in the art, any combination of supply ports within the chamber throat, or within the rifled bore may be utilized.

The pressure supply ports 26 have a sufficient combined cross sectional area to allow the rapid pressurization of the interconnect passage 44 and release ports 28. A small diameter of the release ports 26 precludes the brass of the cartridge case 52 from excessive deformation out into the release port opening under the initial pressure of the ignited propellant. A large diameter release port 26 may result in permanent, or inelastic, distortion of the brass cartridge case at the release port locations due to the propellant pressure. Such permanent distortion, or bulging, of the cartridge case 52 into the release ports would interfere with the extraction of the fired cartridge case 52 from the barrel chamber 22, and reduce the force applied by the cartridge to the bolt face 60. In a preferred exemplary embodiment of the present invention, the cartridge is a 0.22 Magnum. The release ports piercing the chamber body have a diameter of less than 0.052 inch. And the total cross-sectional area of the multiple supply ports is within +/−25% of the total cross sectional area of the multiple release ports. In a more preferred exemplary embodiment, the 12 (twelve) pressure release ports 28 piercing the chamber body have a diameter of between 0.039-0.043 inch, and have a total cross sectional area of 0.016+/−0.002 square inches. The 6 (six) pressure supply ports 26 piercing the chamber throat have a diameter of between 0.056-0.060 inch a total cross section area of 0.016+/−0.002 square inch.

In a most preferred exemplary embodiment of the present invention, each supply port 26 in the throat of the chamber has a diameter of 0.058 inch. Each release port 28 has a diameter of 0.041 inch. The interconnect passage 44 between the reduced diameter portion of the barrel 20 and the barrel sleeve 40 bore has a radial dimension of 0.012 inch in thickness. As will be appreciated by those skilled in the art, in alternative embodiments of the present invention, the optimum diameter and configurations of the supply ports, release ports, and interconnect passage dimensions, to include the number or cross-sections incorporating release ports, will vary with the caliber and configuration of cartridge for which the barrel assembly is chambered. Another example of a cartridge which will benefit from the application of the present invention in a firearm is the .17 HMR.

As presented in the first embodiment, the barrel assembly 10 uses a barrel 20 with a reduced diameter section on the exterior of the barrel surrounding the chamber 22 and a barrel sleeve 40 having a through bore to engage and surround the chamber end of the barrel. The two component barrel assembly of a barrel and a barrel sleeve, allows for the cost efficient ease of manufacture of each component, followed by a simple assembly operation. The supply ports 26, release ports 28, and reduced diameter forming the interconnect passage 44, are easily machined within the barrel prior to assembly. The barrel sleeve incorporates any required cartridge feed ramp, guide rails, and is further configured to engage the other components of the firearm mechanism. In alternative embodiments of the present invention, the interconnect passage may be formed by a reduced diameter of the barrel, an undercut within the barrel sleeve through bore, a groove or recess on the barrel exterior, a grove or recess on internal bore of the barrel sleeve, or any combination thereof. As will be appreciated by those skilled in the art, other means of fabrication of the barrel assembly may be used to achieve the configuration of pressure interconnected supply ports, interconnect passage, and release ports. The barrel assembly may also be formed as a single component, and employ intersecting drilled passages to achieve the desired porting within the structure.

In another alternative embodiment, the present invention provides for the retrofitting of an existing firearm to fire a new caliber and cartridge. The Government Model 1911A1 semi-automatic handgun is widely used in sport and match shooting. The gun has been manufactured for many years, and is prevalent in the market. The majority of 1911A1 firearms are chambered in .45 ACP caliber. The present invention provides a cost effective conversion kit to achieve a firearm for shooting the .22 Magnum cartridge by the re-use of select 1911A1 components coupled with new components specific to the cartridge. The stock 1911A1 components are unmodified and the firearm may be returned to the original configuration at any time.

The new components for the conversion include a barrel assembly with a ported chamber and barrel sleeve, slide with modified breech, recoil spring, spring guide rod and plug, slide stop, barrel bushing, ejector, extractor with extractor spring and pin, firing pin and spring, and a magazine assembly. The barrel is chambered to accept the .22 Magnum cartridge and has a bore and rifling appropriate for the caliber. The slide is lightweight component and allows reliable cycling with the limited energy supplied by the .22 Magnum cartridges. The slide is configured to engage the rails of the 1911A1 frame, and configured to function with the stock sear and hammer. The remaining components are configured to function within the 1911A1 frame.

Of special note is the ammunition magazine. Due to the extra length of the .22 WMR cartridge, the cartridge will not fit inside a stock magazine designed for the 1911A1 handgun. The conversion magazine contains and reliably feeds the .22 Magnum cartridges, fits within the stock 1911A1 frame, and functions with the stock 1911A1 magazine release.

While there has been shown a preferred embodiment of the present invention, it is to be understood that certain changes may be made in the forms and arrangement of the elements of the apparatus of the firearm barrel assembly with ported chamber without departing from the underlying spirit, scope, and essential characteristics of the invention. The present embodiment is therefore, to be considered as merely illustrative and not restrictive, the scope of the invention being indicated by the claims rather than the foregoing description, and all changes which come within the meaning and range of equivalence of the claims are therefore intended to be embraced therein.

What is claimed is:

1. A barrel assembly for use in a firearm, the barrel assembly comprising a barrel with a rifled bore, and a chamber for receiving a cartridge therein, the chamber having a throat portion adjacent the rifled bore, the chamber also having a body portion for receiving the cartridge case therein, the cartridge comprising a cylindrical cartridge case, a bullet engaged within the cartridge case, and the cartridge case containing a propellant, the propellant producing a propellant pressure upon ignition of the propellant, the barrel assembly further comprising:

the barrel comprising at least one supply port passing from the chamber throat to a propellant pressure interconnect passage, and at least one release port passing from the propellant pressure interconnect passage and into the chamber body, the supply port thereby in pressure interconnection with the release port via the propellant pressure interconnect passage;

the barrel assembly comprising, a barrel sleeve, the barrel sleeve configured to receive the barrel within the barrel sleeve, and to positively engage the barrel to the barrel sleeve, wherein a recess is formed between the barrel and barrel sleeve, the recess comprising the propellant pressure interconnect passage;

wherein the total cross-sectional area of the supply ports is within +/−25% of the total cross sectional area of the release ports;

wherein upon ignition of the propellant, the bullet is forced by propellant pressure out of the cartridge case and into the rifled bore of the barrel, the propellant pressure passing into the at least one supply port, into the propellant pressure interconnect passage, and into the at least one release port, the propellant pressure then exerted upon the exterior of the cylindrical cartridge case; and wherein the static bond due to propellant pressure between the cartridge case and the barrel chamber is thereby reduced.

2. The barrel assembly of claim 1, further comprising:

the firearm having a firearm mechanism;

wherein upon propellant pressure passing into the at least one release port, the cartridge case is released from the barrel chamber, and is driven back against a bolt of the firearm mechanism by the propellant pressure; and the firearm mechanism then cycling, wherein a new cartridge is forced into the barrel chamber.

3. The barrel assembly of claim 1, further comprising:

a recess in the outer circumference of the barrel at the portion of the barrel engaged by the barrel sleeve, forming the propellant pressure interconnect passage.

4. The barrel assembly of claim 1, further comprising:

a recess in the inner bore of the barrel sleeve, at the portion of the barrel sleeve engaged by the barrel, forming the propellant pressure interconnect passage.

5. The barrel assembly of claim 1, further comprising:

the diameter of the at least one release port is less than 0.052 inch.

6. The barrel assembly of claim 1, further comprising:

the diameter of the at least one release port is between 0.039 inch to 0.043 inch.

7. The barrel assembly of claim 1, further comprising:

the diameter of the at least one supply port is between 0.056 inch to 0.060 inch.

8. The barrel assembly of claim 1, further comprising:

a total of 6 supply ports pass through the barrel and into the chamber throat, the supply ports equally spaced around the circumference of the barrel, and at two distinct cross sections within the chamber body of the barrel, 6 release ports pass through the barrel and into the chamber body, the release ports equally spaced around the circumference of the barrel, for a total of 12 release ports passing through the barrel and into the chamber body.

9. The barrel assembly of claim 1, further comprising:

the cartridge is at least one of: a .22 caliber Magnum, a .17 HMR.

10. The barrel assembly of claim 1, wherein the barrel sleeve is affixed to the barrel by at least one of: a pin, a threaded connection.

11. The barrel assembly of claim 1, wherein a portion of the interconnect passage is formed by intersecting drilled passages.

* * * * *